US005877446A

United States Patent [19]

Monahan et al.

[11] Patent Number: 5,877,446

[45] Date of Patent: Mar. 2, 1999

[54] DATA COMPRESSION OF SOUND DATA

[75] Inventors: Kevin J. Monahan; Donna L. Murray, both of Santa Cruz, Calif.

[73] Assignee: Creative Technology, Ltd., Singapore, Singapore

[21] Appl. No.: 931,436

[22] Filed: Sep. 16, 1997

Related U.S. Application Data

[63] Continuation of Ser. No. 686,054, Jul. 24, 1996, abandoned, which is a continuation of Ser. No. 414,148, Mar. 30, 1995, abandoned, which is a continuation of Ser. No. 252,066, Jun. 1, 1994, abandoned, which is a continuation of Ser. No. 876,113, Apr. 28, 1992, abandoned, which is a continuation of Ser. No. 465,732, Jan. 18, 1990, abandoned.

[51] Int. Cl.[6] ..... G10H 1/057; G10H 1/08; G10H 1/20

[52] U.S. Cl. ..... 84/603; 84/657; 84/660; 84/663; 84/DIG. 10

[58] Field of Search ..... 84/603–607, 619, 84/622–625, 627, 639–642, 657, 659–661, 663, DIG. 9, DIG. 10, DIG. 26

[56] References Cited

U.S. PATENT DOCUMENTS

| | | | |
|---|---|---|---|
| 4,348,929 | 9/1982 | Gallitzendörfer | 84/607 |
| 4,520,708 | 6/1985 | Wachi | 84/607 |
| 4,633,749 | 1/1987 | Fujimori et al. | 84/607 |
| 4,635,520 | 1/1987 | Mitsumi | 84/607 |
| 4,916,996 | 4/1990 | Suzuki et al. | 84/603 |
| 5,050,474 | 9/1991 | Ogawa et al. | 84/603 |
| 5,086,685 | 2/1992 | Hanzawa et al. | 84/605 |
| 5,094,136 | 3/1992 | Kudo et al. | 84/603 |
| 5,430,241 | 7/1995 | Furuhashi et al. | 84/603 |

*Primary Examiner*—Stanley J. Witkowski

*Attorney, Agent, or Firm*—Townsend and Townsend and Crew LLP

[57] ABSTRACT

A data compression method and apparatus for the compression of sound data utilized in digital sampling keyboard instruments. The present invention reduces memory requirements for sampled sounds without compromising sound quality, utilizing processing of sound data samples to delete sound data between the attack portion and just before the loop start portion. The improved method further includes a step of digitally splicing the remaining attack and loop portions to form a spliced data sample.

7 Claims, 15 Drawing Sheets

DATA COMPRESSION OF SOUND DATA

CROSS-REFERENCE TO RELATED APPLICATIONS

This application is a continuation of Ser. No. 08/686,054, filed Jul. 24, 1996, now abandoned; which is a continuation of Ser. No. 08/414,148, filed Mar. 30, 1995, now abandoned; which is a continuation of Ser. No. 08/252,066, filed Jun. 1, 1994, now abandoned; which is a continuation of Ser. No. 07/876,113, filed Apr. 28, 1992, now abandoned; which is a continuation of Ser. No. 07/465,732, filed Jan. 18, 1990, now abandoned.

BACKGROUND OF THE INVENTION

The present invention relates to data compression of sound data, and more particularly to the data compression of sound data utilized in digital sampling keyboard instruments.

Since the introduction of digital sampling keyboard instruments, the desire to compress sound data into smaller memories without compromising sound quality is ever increasing. In recent years, limiting bit resolution (8 to 12 bits) and sample rates (less than 44.1 Khz) have been two common methods to reduce memory size. But since the introduction of the compact disk (CD), resolution less than 16-bit and 44.1 Khz has largely been deemed unacceptable.

Another common approach, looping, involves repeating a section of data during the time a key is depressed. Two common types of loops are single period forwards loops and cross-faded forwards loops (see FIGS. 1 and 2). Single period (or single cycle) loops characteristically sound quite static, as only one period is repeated. They work best on solo instruments with non-complex harmonic structures. Longer loops, on the other hand, are required for ensemble sounds and harmonically complex solo sounds. Often, the sound data must be processed to avoid pops in the loop. This process is called cross/fade looping. Portions of the sound at the loop start and end points are faded in and out of the loop. Obviously, the longer, cross-faded loop contains more dynamics than a single-cycle loop. However, some lower frequency phase cancellation occurs as a result.

The start point of a cross/faded loop must begin after the attack phase of the sound has passed and the sound becomes more stable. The problem here is that it often takes a while for a sound to become stable. If a loop is started too close to the attack, poor loops result due to large fluctuations in phase and amplitude, and there is a high risk of attack data becoming part of the loop.

Yet another method for reducing memory is to simply take fewer samples of a given instrument across the keyboard. A single sample of a violin will use less memory than one that has been sampled every half octave. The problem here is that the realism of the sound disintegrates rapidly when too few samples are used to represent a fixed formant instrument.

SUMMARY OF THE INVENTION

It is an object of the present invention to provide an improved data compression method and apparatus to be utilized with digital sampling keyboard instruments.

A more particular object of the invention is to reduce memory requirements for sampled sounds without compromising sound quality, using three techniques. Additionally, the third technique improves the defect of formant distortion when sampled sounds are transposed.

Briefly, the present invention is directed toward, in one preferred embodiment, an improved method for processing sound data samples where the data samples have an attack portion and a cross/faded loop portion, including the step of deleting the sound data between the attack portion and just before the loop start portion. The improved method further includes the step of digitally splicing the remaining attack and loop portions to form a spliced data sample.

Additional objects, advantages and novel features of the present invention will be set forth in part in the description which follows and in part become apparent to those skilled in the art upon examination of the following, or may be learned by practice of the invention. The objects and advantages of the present invention may be realized and attained by means of the instrumentalities and combinations which are pointed out in the appended claims.

BRIEF DESCRIPTION OF THE DRAWINGS

The accompanying drawings which are incorporated in and form a part of this specification illustrate an embodiment of the inventin and, together with the description, serve to explain the principles of the invention.

DETAILED DESCRIPTION OF THE INVENTION

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, it is intended to cover alternatives, modifications and equivalents as may be included within the spirit and scope of the invention as defined by the appended claims.

Figure 15:
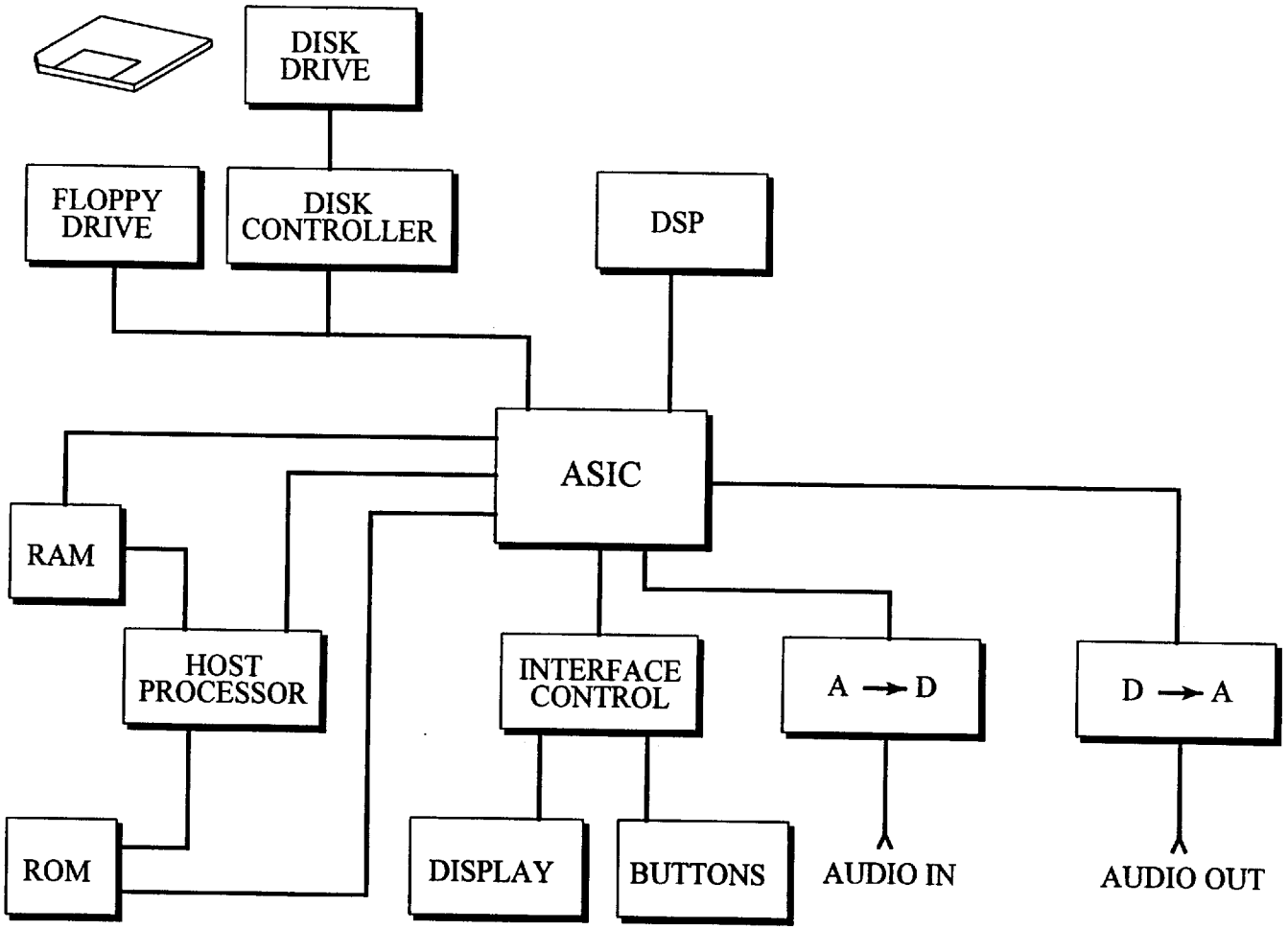
FIG. 15 is a block diagram of a signal processing system suitable for implementing the present invention.

FIG. 15 depicts a signal processing system 100 suitable for implementing the present invention. In one embodiment, signal processing system 100 captures sound samples, processes the sound samples, and plays out the processed sound samples. The present invention is, however, not limited to processing of sound samples but also may find application in processing, e.g., video signals, remote sensing data, geophysical data, etc. Signal processing system 100 includes a host processor 102, RAM 104, ROM 106, an interface controller 108, a display 110, a set of buttons 112, an analog-to-digital (A-D) converter 114, a digital-to-analog (D-A) converter 116, an application-specific integrated circuit (ASIC) 118, a digital signal processor 120, a disk controller 122, a hard disk drive 124, and a floppy drive 126.

Figure 1:
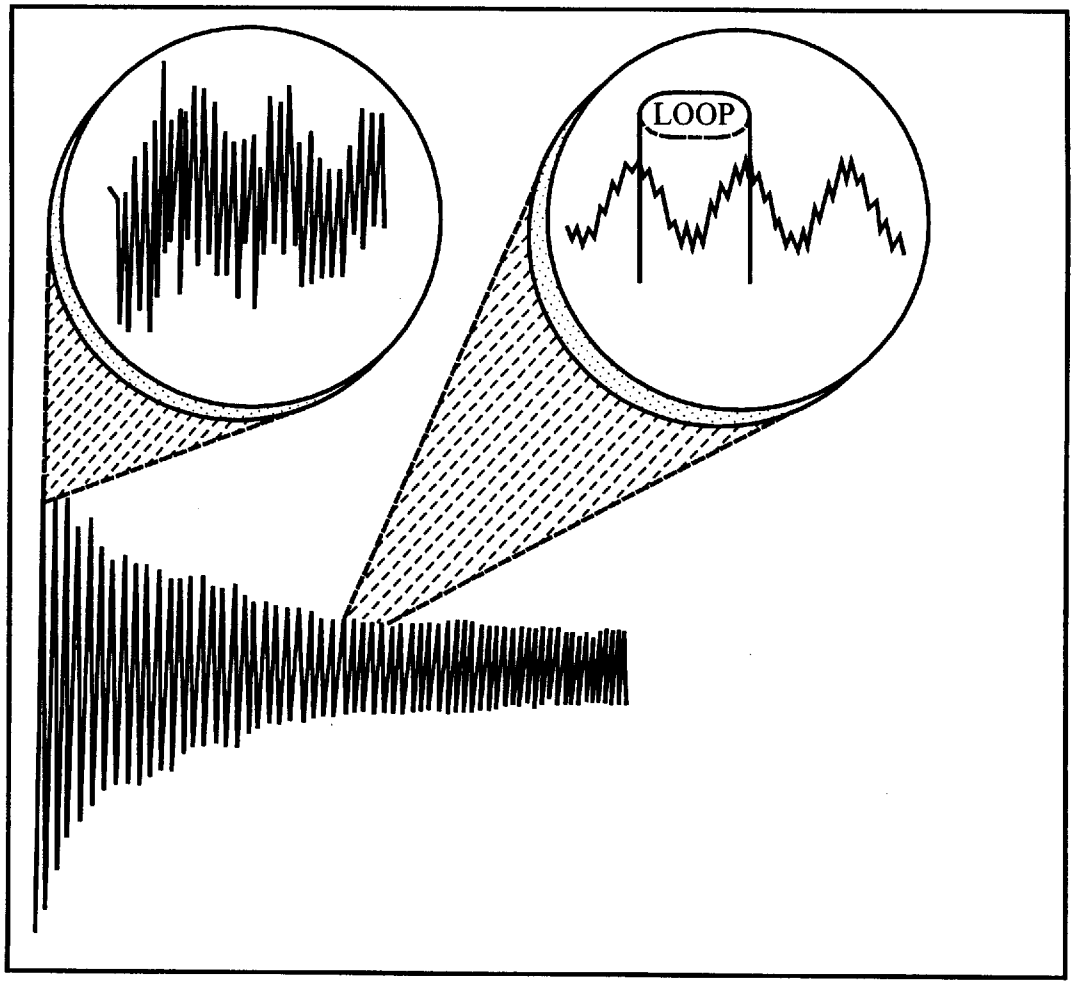
FIG. 1 depicts a single-cycle forwards loop.
Figure 2:
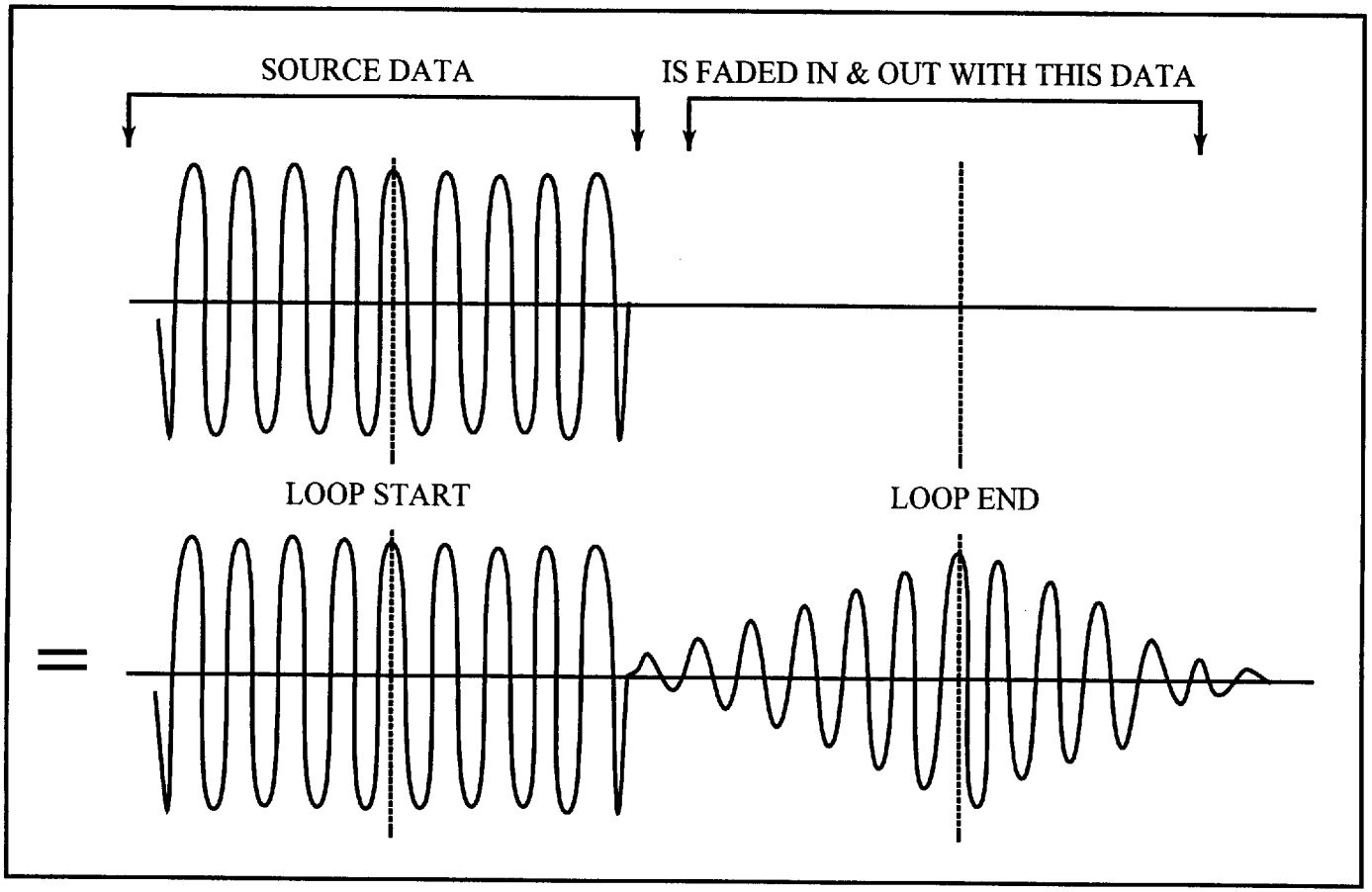
FIG. 2 depicts a cross-fade looping process.
Figure 3:
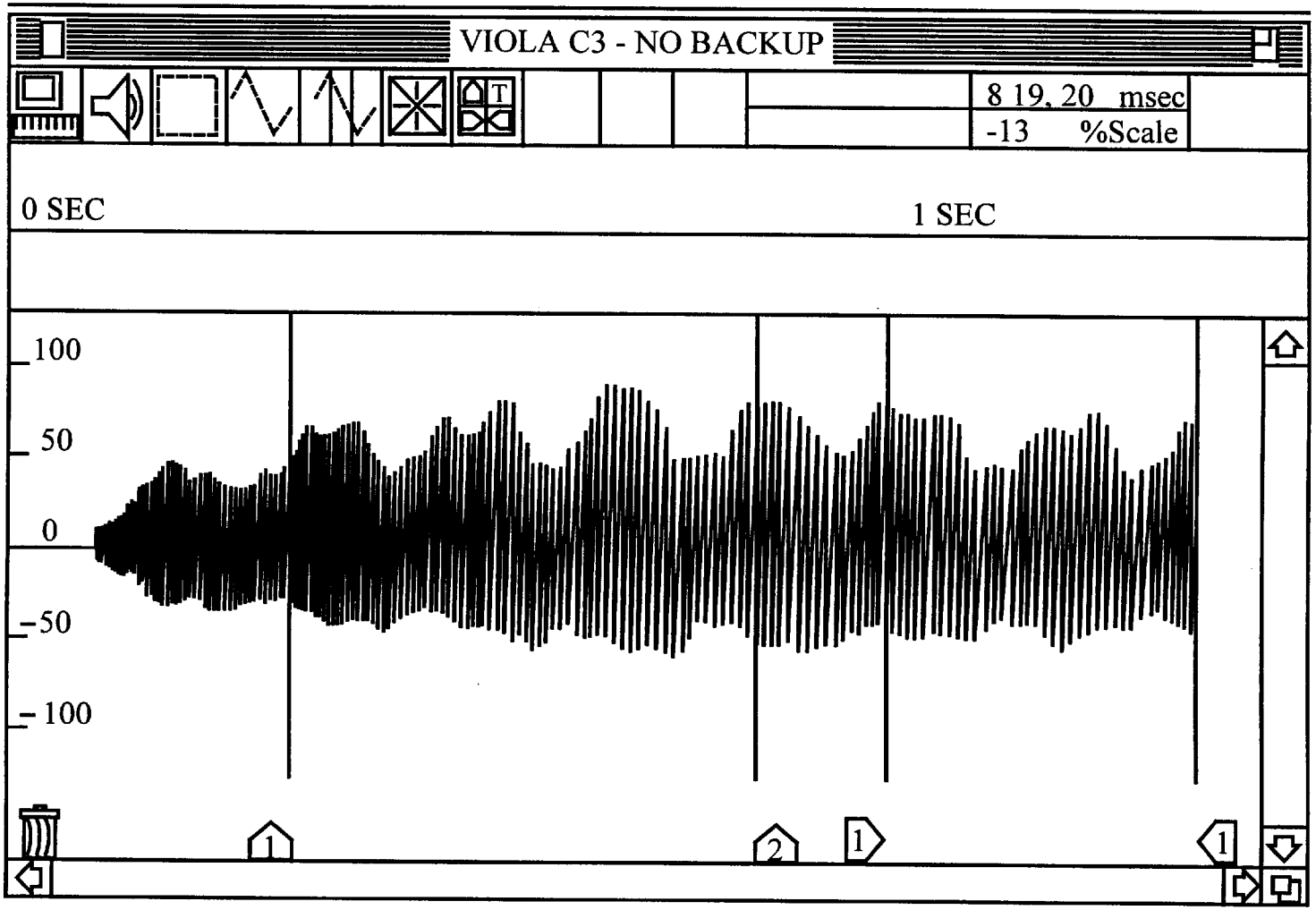
FIG. 3 depicts a conventional cross-faded loop.
Figure 4:
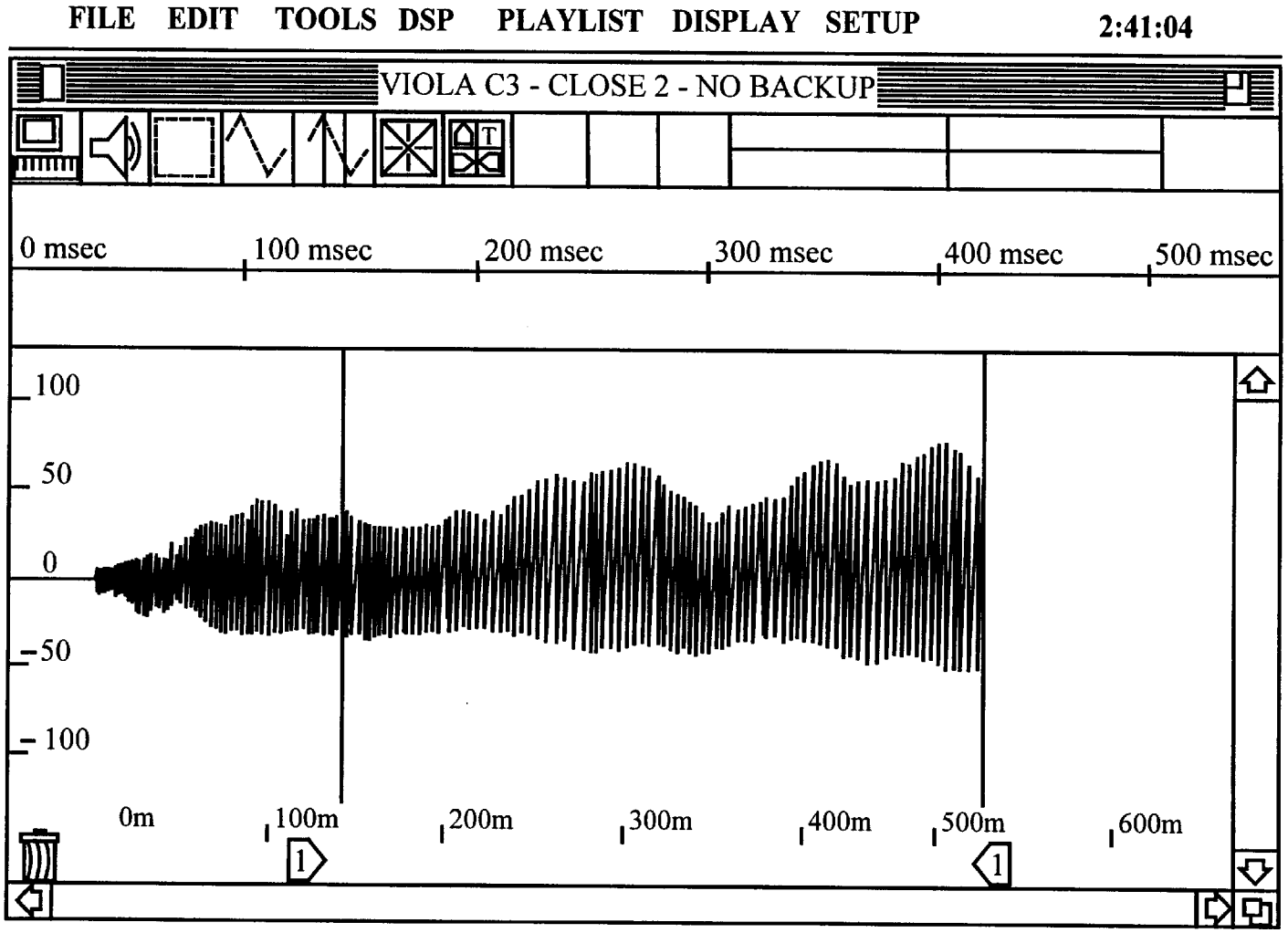
FIG. 4 depicts a conventional cross-faded loop too close to attack.
Figure 5:
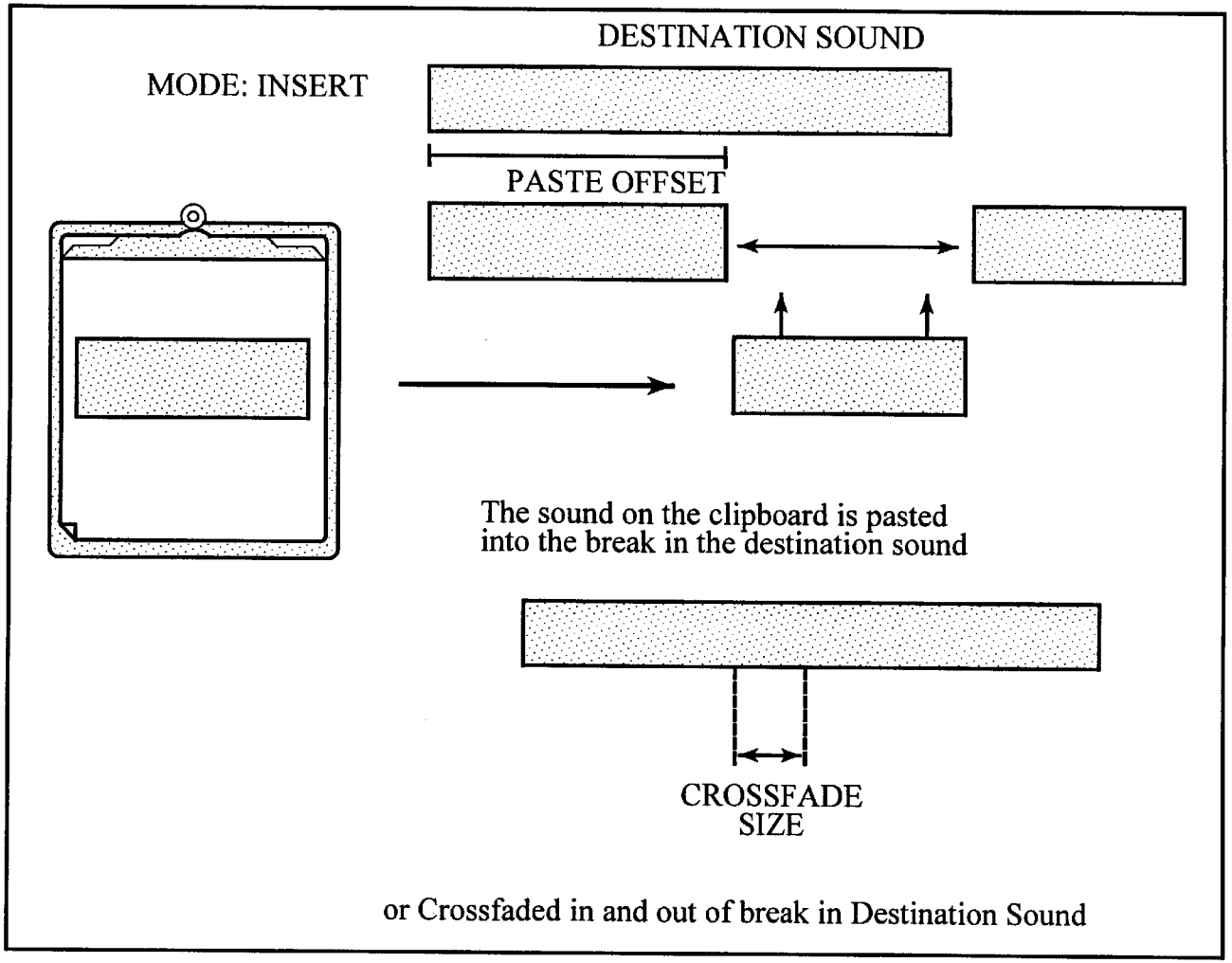
FIG. 5 depicts cut, copy and paste procedures.
Figure 6:
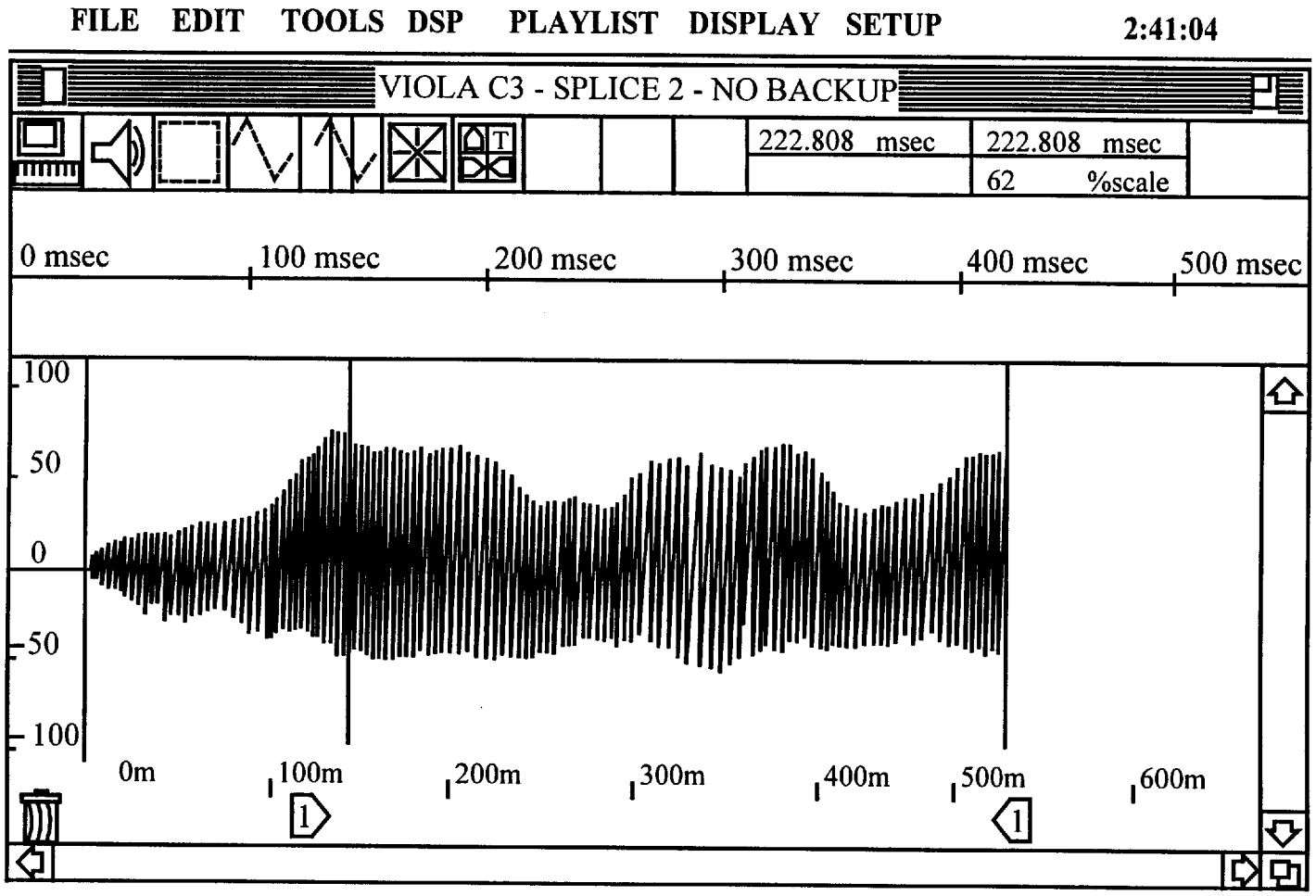
FIG. 6 depicts attack/loop splice.

One technique according to the present invention for data reduction (FIG. 3–6) utilizes cut and paste editing tools to reduce a sound to its most essential components, attack and loop (sustain). FIG. 3 shows a string sample that has been cross-fade looped well after the attack. Sonically, this example is correct, but requires more memory than is desirable (57K). In FIG. 4, the same sample has been looped much closer to the attack of the sound, producing the desired memory reduction (22K), but now the loop contains elements of the attack. Because of the instability of the sound at that point in time, the loop has an undesirable amount of fluctuation.

Returning to FIG. 3, it can be seen that the sound data between the attack (approximately 125 ms) and just before the loop start (approximately 100 ms) can be deleted. The remaining portion (the attack and loop) can be digitally spliced together with up to 100 ms X/fade time. The X/fade will prevent any audible pop in the splice and the fade time is limited by the size of data before the loop start, which in this case is 100 ms or 4410 bytes at 44.1 Khz sample rate. (See FIG. 5)

The resulting sample (FIG. 6) not only saves memory but can sound significantly better than the example in FIG. 3, because the unstable portion of the sample has been eliminated.

A second technique (FIGS. 7–11) according to the present invention utilizes a phase linear filter to separate a sample into multiple bands that can be individually processed and looped much closer to the attack, then digitally recombined. The use of finite impulse response digital filters of consistent order between bands insures no phase distortion of the result after recombining.

Figure 7:
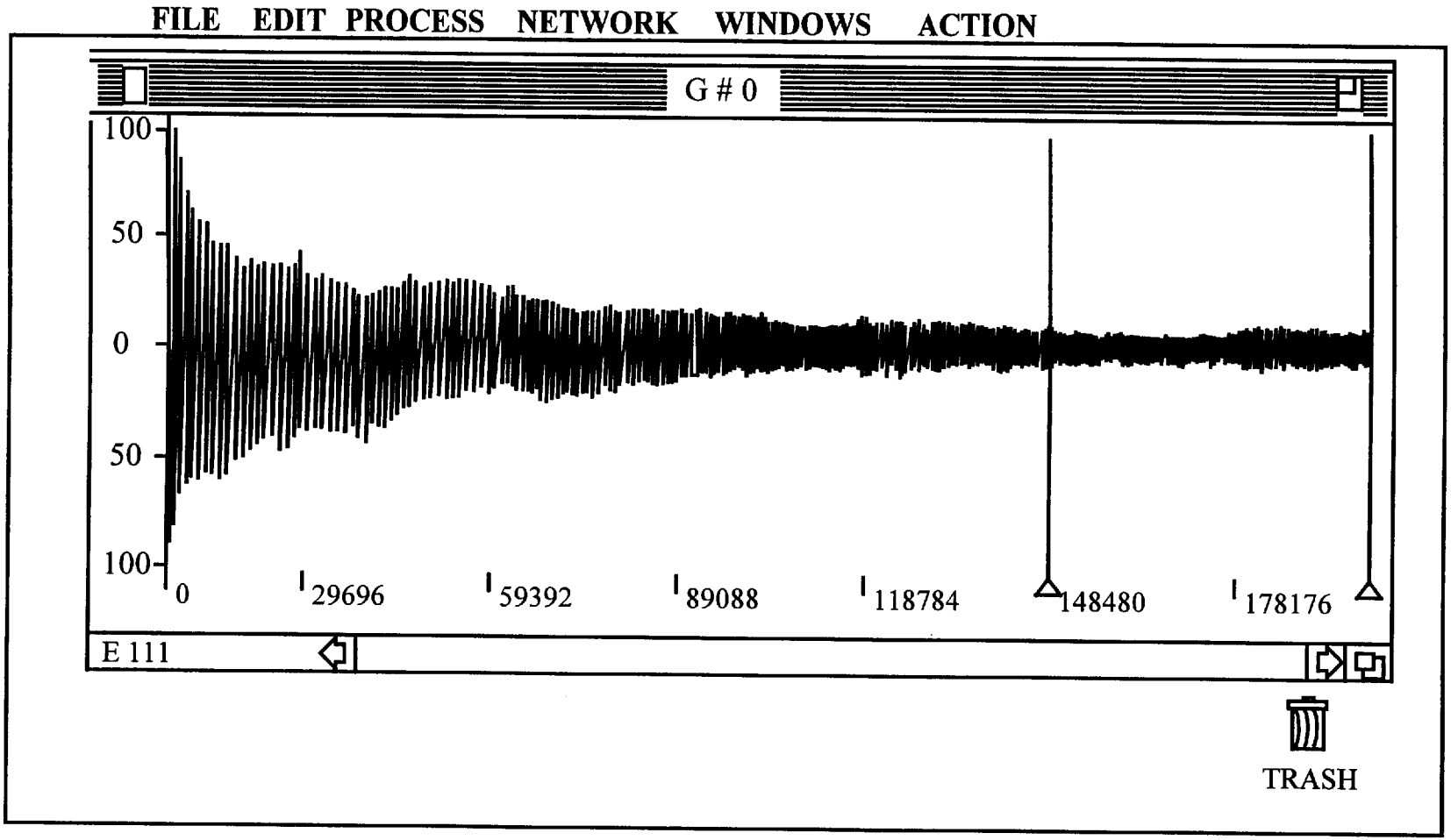
FIG. 7 depicts piano sample with conventional cross-fade loop.
Figure 8:
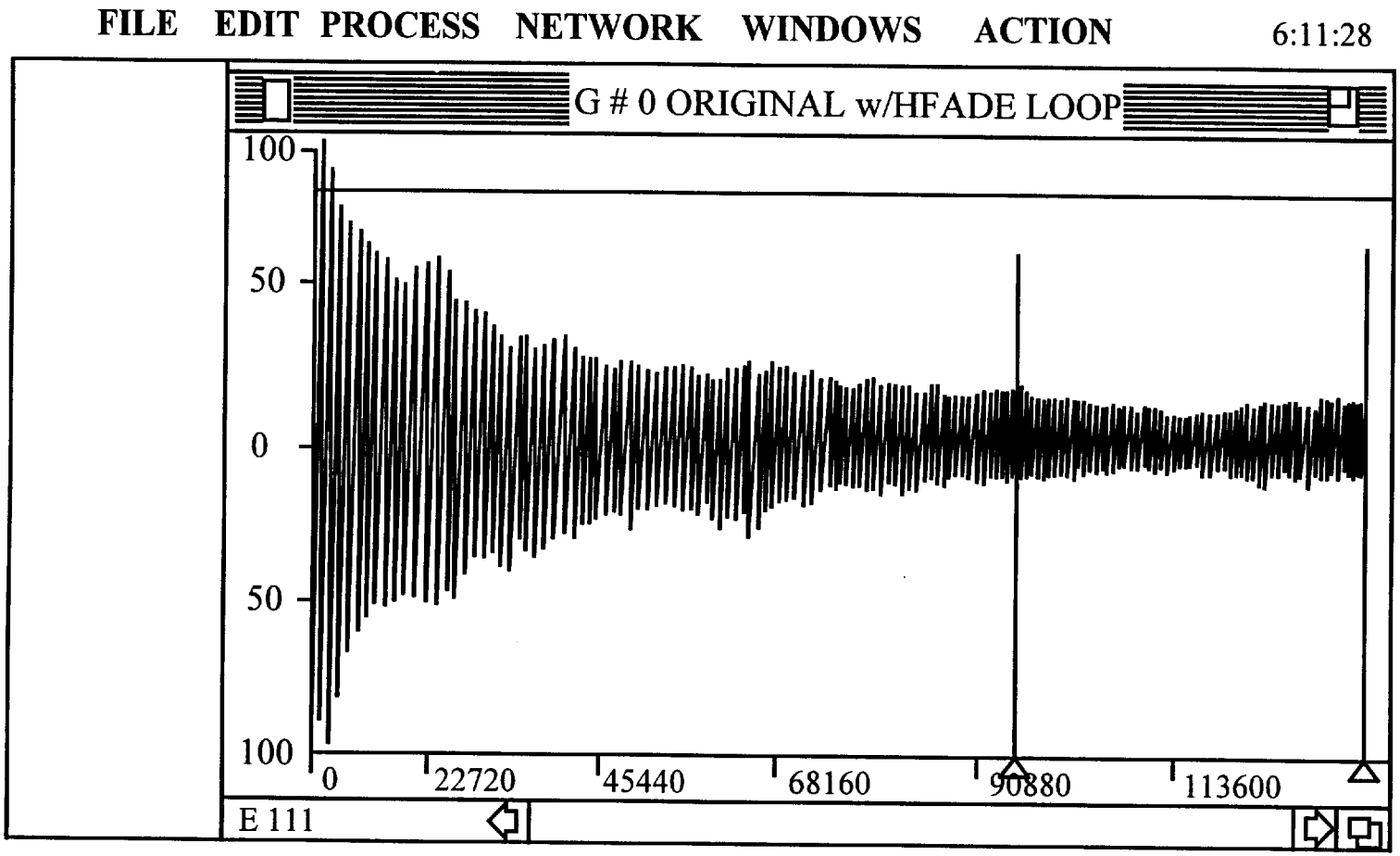
FIG. 8 depicts piano sample with conventional cross-fade loop closer to attack, showing fluctuation in loop.

FIG. 7 shows a piano sample that has been crossfade looped. A shorter sample is desired. In this example, a single cycle loop of the original sample would sound very static and unnatural. Use of a cross-faded loop closer to the attack results in excessive tremolo effects due to the amound of animation still present in the looping area of the sound and the phase cancellation byproducts of crossfading, as shown in FIG. 8.

The variations of lower frequency components in the loop are what cause the the undesirable tremolo effects, but variations of higher frequency components in the loop are useful to maintain an animated sound. Bandsplitting the shorter sample allows the low-frequency components to be single-cycle looped, and the high-frequency components to use cross-faded loops. The result after recombining the bands is a loop that sounds stable but still animated.

Figure 9:
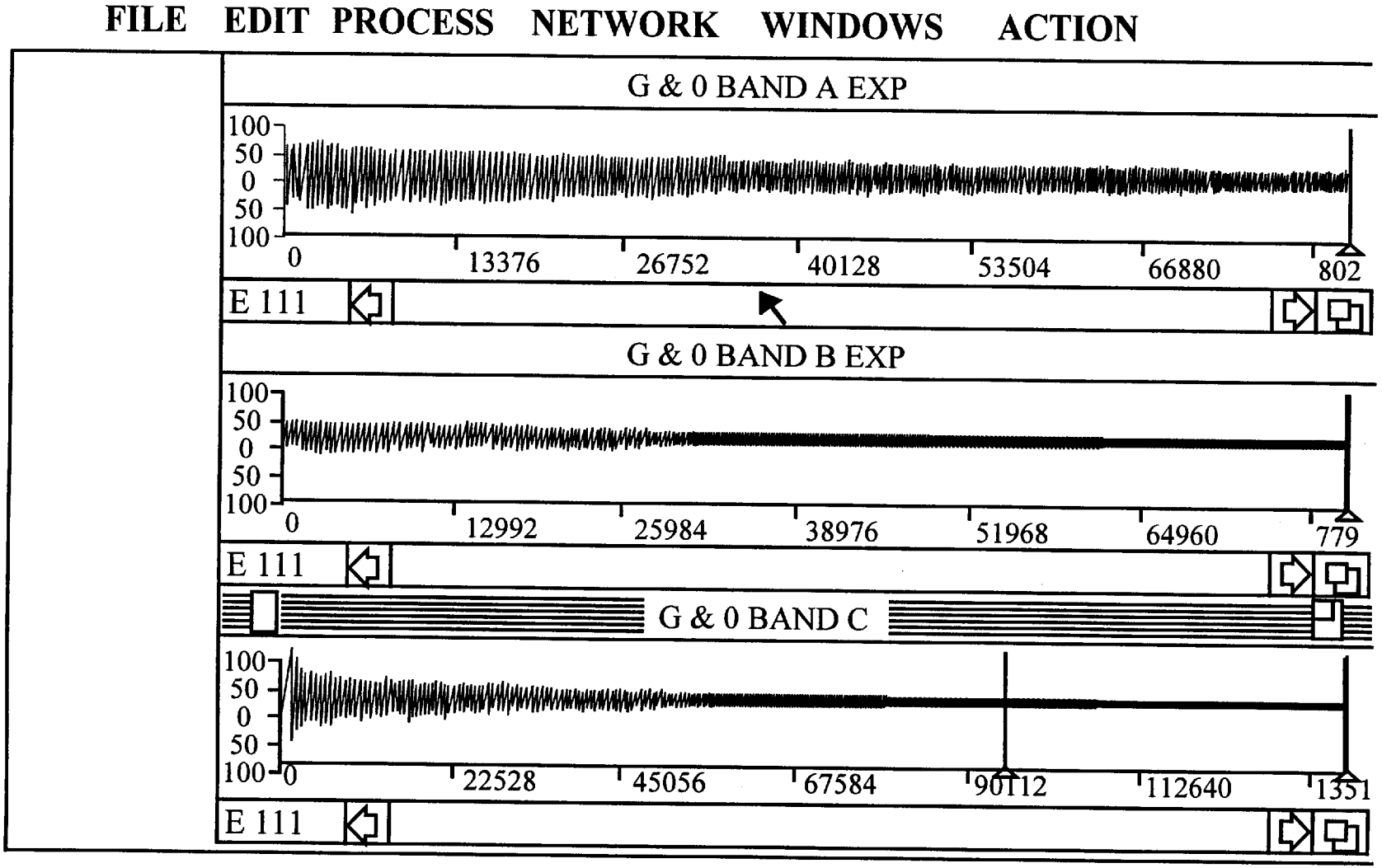
FIG. 9 depicts piano sample band split and looped separately.

In FIG. 9, the piano sample has been split into three bands using a lowpass, bandpass and highpass phase-linear filter. Band A has been lowpassed, leaving mostly the fundamental frequency (51 hz, G#0). Band B has been bandpassed, leaving only the second harmonic. Band C has been highpassed, leaving the remainder of the sound.

Band A is looped using a single cycle loop and band B is looped at the same length (which is actually a double cycle loop). Band C is looped using a much longer crossfade loop. The only restriction here is that the longest loop length of all the bands must be an integer multiple of the other loop lengths to allow for proper recombination later. In this case, loops in A and B are 850 bytes and the loop in C is 45900 bytes (54 times as long).

Figure 10:
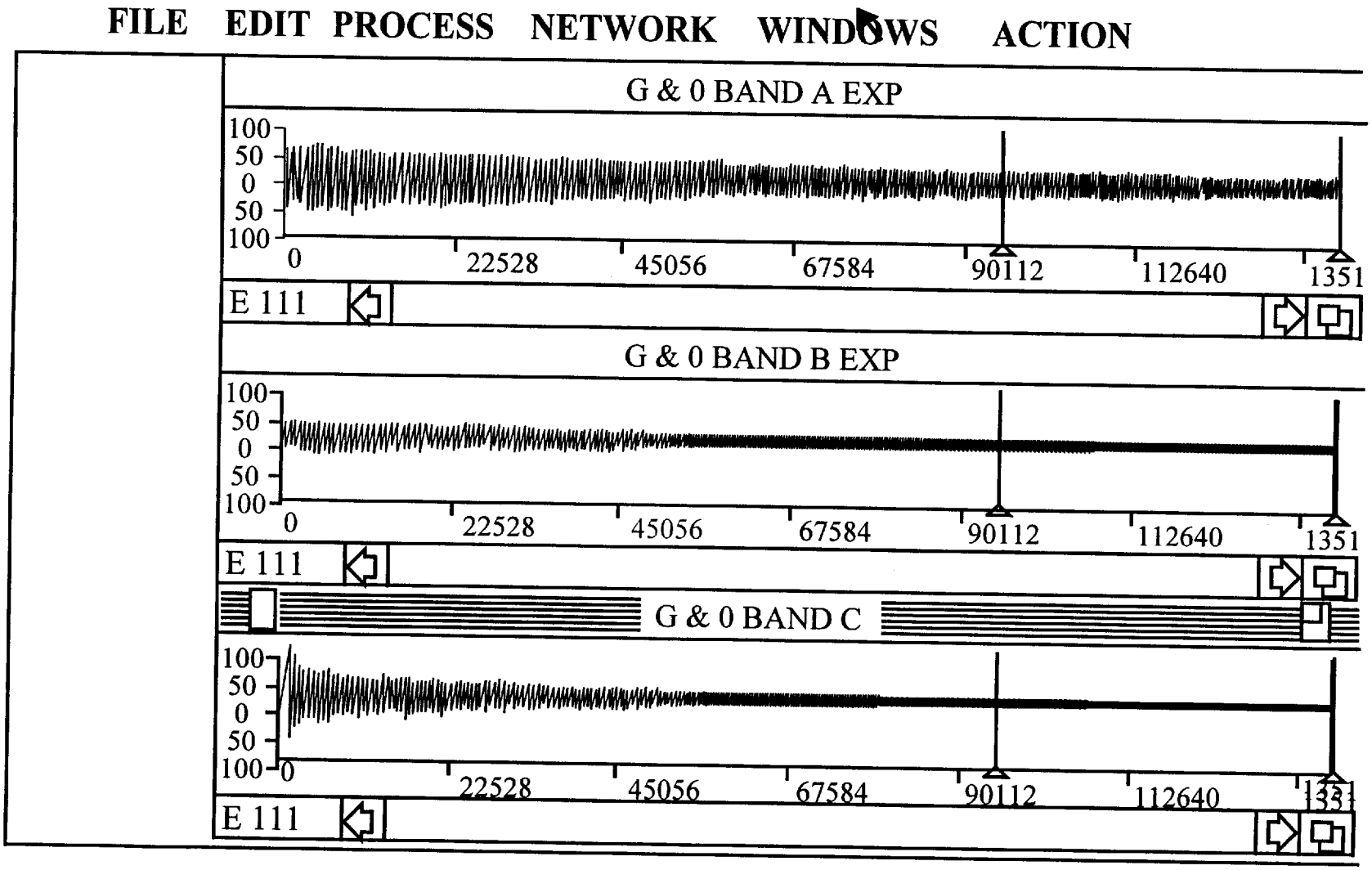
FIG. 10 depicts piano sample band split and loops equalized.

In order to recombine the three bands back into one sample, the loop lengths must first be equalized (FIG. 10). This is accomplished by first copying the loop data in band A many times until a loop length equal to that of C is achieved. In this case, multiplying the loop 54 times provides the correct loop length, but the loop start must also occur at exactly the same point. Simply moving the loop start points of band A to that of band C may result in a less desirable band A loop. Therefore, the loop data in band A should be copied an additional number of times until enough data is created to produce a loop length of 45900 bytes at a start point equal to band C, 94779 bytes. This process is repeated for band B, yielding three bands that all have loops which start at 94779 bytes and are 45900 bytes in length.

Figure 11:
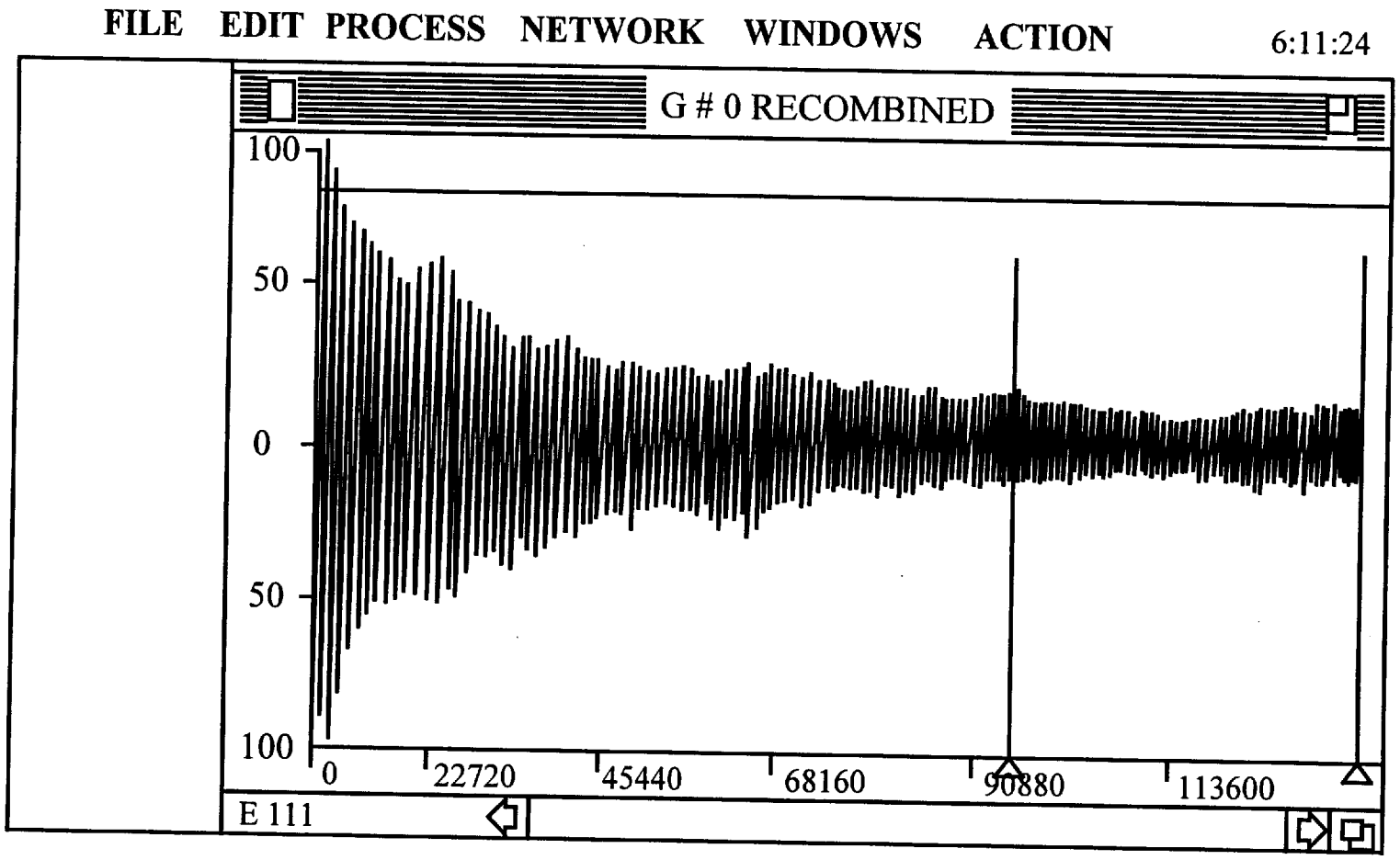
FIG. 11 depicts piano sample bands recombined with a resultant loop closer to attack.

With the loops equalized, the three bands can now be recombined (FIG. 11). The resultant sample has a very natural sustain with some motion in the higher frequencies and very little in the lower ranges. If the original sample had been looped using conventional X/fade looping methods, it would be necessary to start the loop much further from the attach to achieve a similar loop stability (FIG. 7). Otherwise, the sample would contain phase cancellation defects in the low end, which can be observed in FIG. 8.

A third data compression technique according to the present invention combines two or more pitches of ensemble sounds into one sample, thereby creating larger sounds in less memory, as well as reducing formant distortion due to pitch-shifting.

When a fixed-formant sampled sound is shifted flat or sharp upon playback, it sounds uncharacteristic. An obvious example would be a single section vocal "aah" sample stretched up and down an octave. The sizes of the vocalists seem to grow and shrink unrealistically. This phenomenon is sometimes called "munchkinization."

Figure 12:
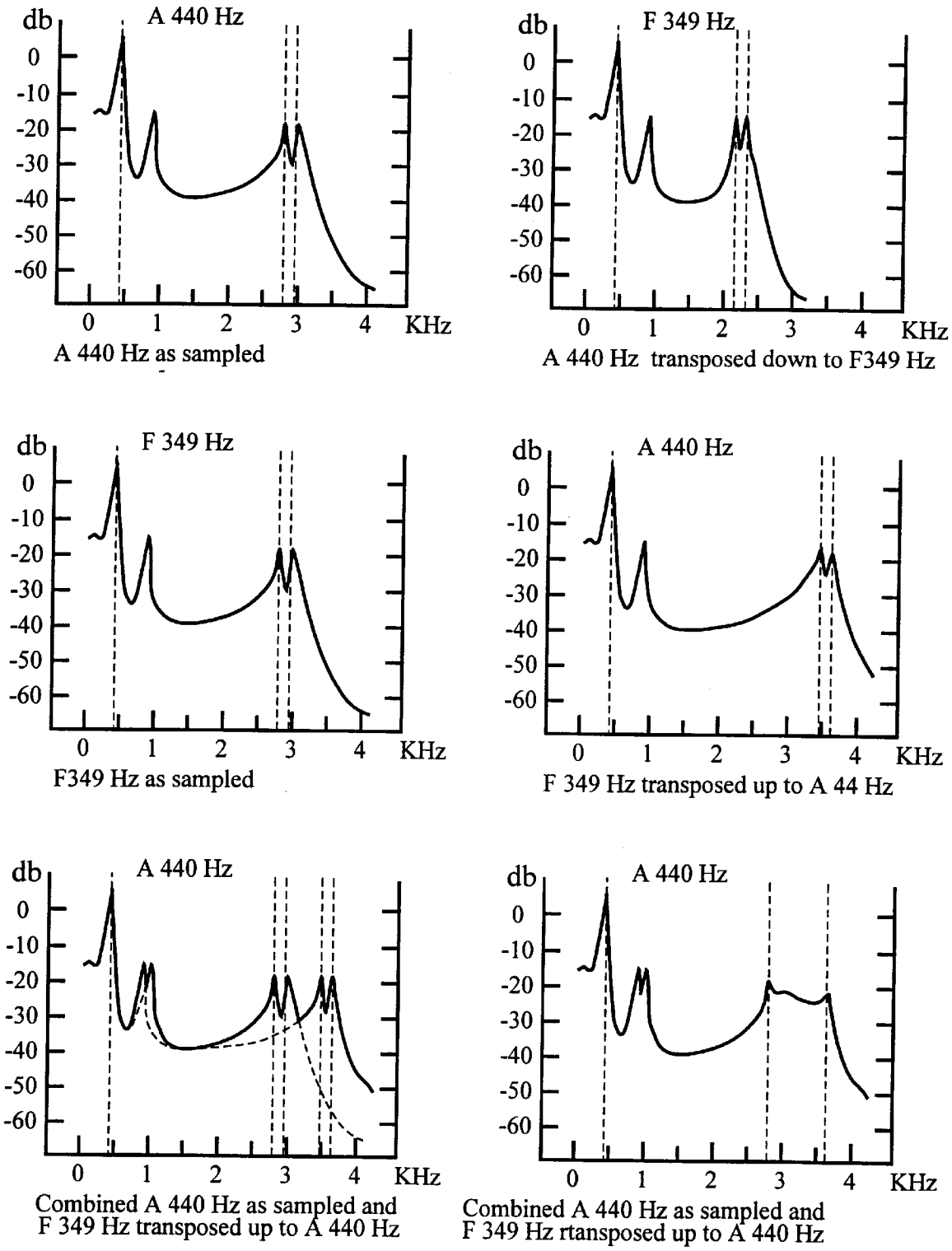
FIG. 12 depicts formant shifting.

FIG. 12 illustrates formant transposition as a result of pitch-shifting the vowel "ah" from A 440 Hz to F 349 Hz and from F 349 Hz to A440 Hz. When compared with the original pitches, the transposed versions exhibit a deviation in formant location.

By digitally re-tuning F 349 Hz to A440 Hz, then digitally combining it with the original A 440 Hz sample, the resultant formant location more closely approximates that of the original A 440 Hz sample. Also, since the combined version contains formant characteristics of both pitches, the effective transposition range has been increased and a larger section sound produced within each sample.

Figure 13:
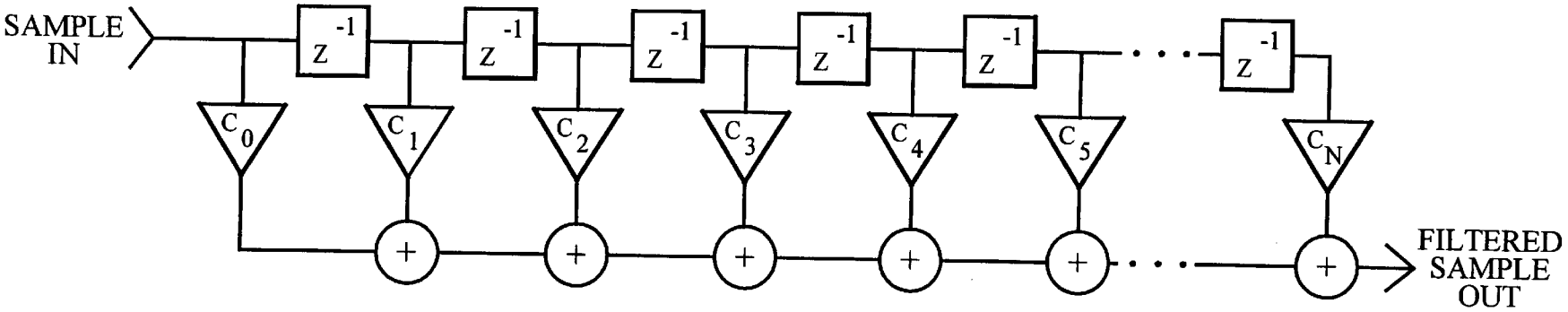
FIG. 13 depicts a diagram of a digital finite impulse response (FIR) filter.

Referring now to FIG. 13, there is shown therein a digital finite impulse response filter. The filter coefficients, $c_i$, must all be real to insure a linear phase response. The order of the filter is the number of stages, N.

Figure 14:
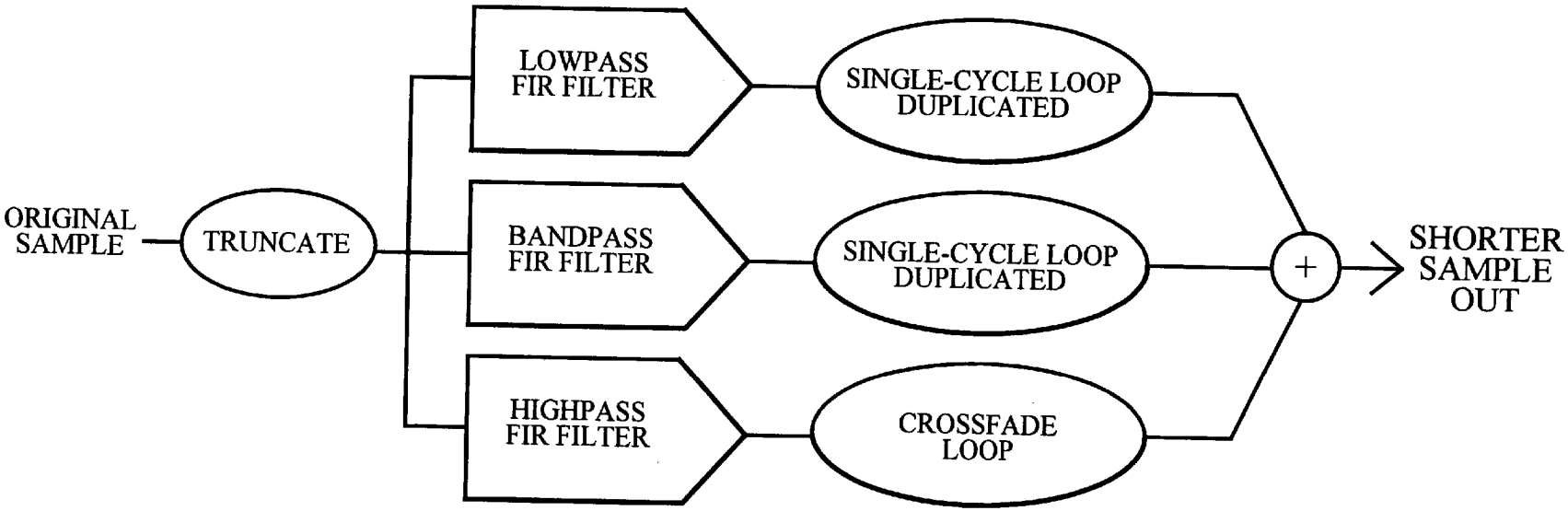
FIG. 14 depicts a diagram of a data compression technique in which lowpass, bandpass and highpass FIR filters are utilized.

FIG. 14 illustrates a data compression technique according to the present invention in which the original sample is truncated, band split (in this case, into three bands), separately looped, and then recombined. The result is much shorter sample. All band split filters in FIG. 14 are of the same order to insure phase consistency upon recombination.

In FIG. 14, after truncation lowpass, bandpass and highpass filtering is performed, as described above. The output of the lowpass FIR filter is then single cycle loop duplicated.

The output of the bandpass FIR filter is single cycle loop duplicated.

The output of the highpass FIR filter is cross/fade looped. The looped bands are then combined, as shown in FIG. 14.

The aspects of the present invention can be achieved by utilizing suitable digital sampling keyboard instruments such as the EMULATOR III which is manufactured by the same applicant as the present invention herein, namely E-mu Systems, Inc. of Scotts Valley, Calif. Also, commercially available sound processing software can be utilized in conjunction with such a suitable digital sampling instrument to provide data compression of sound data according to the present invention.

The foregoing description of the preferred embodiment of the present invention has been presented for purposes of illustration and description. It is not intended to be exhaustive or to limit the invention to the precise form disclosed, and many modifications and variations are possible in light of the above teaching. The preferred embodiment was chosen and described in order to best explain the principles of the invention and its practical applications to thereby enable othrs skilled in the art to best utilize the invention and with various embodiments and with various modifications as are suited to the particular use contemplated. It is intended that the scope of the invention be defined only by the claims appended hereto.

What is claimed is:

1. In a data compression method for the compression of sound data samples, the method comprising steps of:

splitting a sound data sample, having a fundamental frequency and a plurality of harmonic frequencies associated therewith, into a lowpass band, a bandpass band and a highpass band, such that the lowpass band includes the fundamental frequency of said data sample, the bandpass band includes the second harmonic frequency of said data sample, and the highpass band includes the remainder of the sound, looping the lowpass band and the highpass band, using a single cycle loop and a double cycle loop to form a lowpass loop length and a highpass loop length, respectively, with said lowpass loop length defining a first looped band and said highpass loop length defining a second looped band, looping the highpass band using a cross fade loop such that the longest loop length is an integer multiple of the other loop lengths, defining a third looped band, and recombining the first, second and third looped bands into a recombined data sample.

2. The method as in claim 1 wherein the recombining step includes equalizing the loop lengths associated with said first, second and third looped bands.

3. The method as in claim 2 wherein the first, second and third looped bands starts occur at the same respective point.

4. In a data compression method for the compression of sound data sample, the method comprising steps of:

splitting a sound data sample, having a fundamental frequency, into at least a first band and a second band, such that said first band includes the fundamental frequency of said data sample, and the second band includes the remainder of the sound, looping the first band using a single cycle loop to form a first loop length, defining a first loop band, looping the second band using a cross fade loop such that the longest loop length is an integer multiple of the first loop length, defining a second loop band, and recombining the first and second loop bands into a recombined data sample.

5. Data compression apparatus for compression of sound data samples, the apparatus comprising:

means for splitting a sound data sample, having a fundamental frequency and a plurality of harmonic frequencies, into a lowpass band, a bandpass band and a highpass band, such that the lowpass band includes the fundamental frequency of said data sample, the bandpass band includes the second harmonic of said data sample, and the highpass band includes the remainder of the sound, first means, in data communication with said splitting means, for looping the lowpass band and highpass band, using a single cycle loop and a double cycle loop to form a lowpass and highpass loop length, respectively, with said lowpass loop length defining a first looped band and said highpass loop length defining a second looped band, second means, in data communication with said first looping means, for looping the highpass band using a cross fade loop such that the longest loop length is an integer multiple of the other loop lengths, defining a third looped band, and means, in data communication with both said first and second looping means, for recombining the first, second and third looped bands into a recombined data sample.

6. In a data compression method for compression of sound data, the method comprising steps of sampling primary and secondary sound data samples at first and second sampling frequencies, respectively, each of said primary and said secondary sound data samples having an attack portion, an intermediate portion and a loop portion, processing each of said primary and said secondary sound data samples having an attack portion and a cross-fade loop portion, including a step of deleting sound data between the attack portion and the loop portion, digitally splicing the remaining attack and loop portions of each of said primary and said secondary sound data samples with a predetermined cross-fade time to form first and second spliced sound data samples, each of which has a fundamental frequency and a plurality of harmonic frequencies associated therewith, splitting the first and second spliced sound data samples into a lowpass band, a bandpass band and a highpass band, such that the lowpass band includes the fundamental frequency of one of said first and second spliced sound data samples, the bandpass band includes the second harmonic of one of said first and second spliced sound data samples, and the highpass band includes the remainder of the sound, looping the low pass and bandpass bands of each of said first and second spliced sound data samples using a single cycle loop for the lowpass band and a double cycle loop for the highpass band, looping the highpass band of each of said first and second spliced sound data samples using a cross-fade loop such that the longest loop length of a given sample is an integer multiple of the other loop lengths that sample, recombining the looped bands of each of said first and second spliced sound data samples into a first and a second recombined data samples, pitch shifting one of said first and second recombined data samples to the remaining of said first and second recombined data samples to form a formant transposition thereof, defining transposed samples, and digitally combining one of said primary and said secondary sound data samples with said transposed samples to form a combined sound data sample.

7. Data compression apparatus for the compression of sound data samples, the apparatus comprising:

means for sampling primary and secondary sound data samples at first and second sampling frequencies, respectively, each of said primary and secondary sound data samples having an attack portion, an intermediate portion and a loop portion, means, in data communication with said sampling means for processing each of said primary and secondary sound data samples having an attack portion and a cross/faded loop portion, by deleting sound data between the attack portion and the loop portion, means, in data communication with said processing means, for digitally splicing the remaining attack and loop portions of each of said primary and secondary sound data samples with a predetermined cross fade time to form first and second spliced sound data samples, each of which includes a fundamental frequency and a plurality of harmonic frequencies, means, in data communication with said splitting means, for splitting each of said first and second spliced sound data samples into a lowpass band, a bandpass band and a highpass band, such that the lowpass band includes the fundamental frequency of one of said first and second spliced sound data samples, the bandpass band includes the second harmonic of said one of said first and second spliced sound data samples, and the highpass band includes the remainder of the sound, means, in data communication with said splitting means, for looping the lowpass and bandpass bands of each of said first and second spliced sound data samples, using a single cycle loop for the lowpass band and a double cycle loop for the highpass band, forming first and second looped bands, respectively, means, in data communication with both said looping means, for recombining the first and second looped bands into first and second recombined data samples, means, in data communication with said recombining means, for pitch shifting one of said first and second recombined data samples to the remaining of said first and second recombined data samples to form a formant transposition thereof, detecting transposed samples and means, in data communication with both said pitch shifting means and said sampling means, for digitally combining one of said primary and secondary sound data samples and transposed samples to form a combined sound data sample.

* * * * *